US005412407A

United States Patent [19]

Okubo et al.

[11] Patent Number: 5,412,407

[45] Date of Patent: May 2, 1995

[54] HEAT TRANSFER RECORDING APPARATUS WITH COMMON DRIVE SOURCE FOR DRIVING PLURAL ELEMENTS

[75] Inventors: Akio Okubo, Tokyo; Toshiyuki Hayashi; Masahiro Funakoshi, both of Yokohama, all of Japan

[73] Assignee: Canon Kabushiki Kaisha, Tokyo, Japan

[21] Appl. No.: 182,386

[22] Filed: Jan. 18, 1994

Related U.S. Application Data

[63] Continuation of Ser. No. 844,939, Mar. 4, 1992, which is a continuation of Ser. No. 333,283, Apr. 5, 1989, abandoned.

[30] Foreign Application Priority Data

Apr. 7, 1988 [JP] Japan ..... 63-84033

[51] Int. Cl.[6] ..... B41J 2/325; B41J 17/08; B41J 17/10

[52] U.S. Cl. ..... 342/215; 400/185; 400/187; 346/24; 346/136

[58] Field of Search ..... 346/76 PH, 24, 134, 346/136; 400/120, 624, 184, 185, 186, 187; 358/304

[56] References Cited

U.S. PATENT DOCUMENTS 4,617,577 10/1986 Takahashi et al. ..... 346/76 PH
4,660,053 4/1987 Tsutsumi et al. ..... 346/24
4,910,602 3/1990 Sakuragi ..... 346/76 PH
5,041,845 8/1991 Ohkubo et al. ..... 346/76 PH

FOREIGN PATENT DOCUMENTS 60-24030 7/1985 Japan .

*Primary Examiner*—Huan H. Tran
*Attorney, Agent, or Firm*—Fitzpatrick, Cella, Harper & Scinto

[57] ABSTRACT

A heat transfer recording apparatus which is arranged to transfer ink from a heat transfer printing medium to a recording medium by selective application of heat while transporting the heat transfer printing medium and the recording medium. The apparatus is provided with a winding mechanism for winding the heat transfer printing medium, a rewinding mechanism for rewinding the heat transfer printing medium, a transporting mechanism for transporting the heat transfer printing medium and the recording medium, a discharging mechanism for discharging the recording medium, a cutter for cutting the recording medium after completion of image recording, and a driving-force transmitting mechanism for selectively transmitting the driving force of a common drive source to the winding mechanism, the rewinding mechanism, the discharging mechanism, and the cutter.

8 Claims, 9 Drawing Sheets

A-A CROSS SECTION

B-B CROSS SECTION

C-C CROSS SECTION

D-D CROSS SECTION

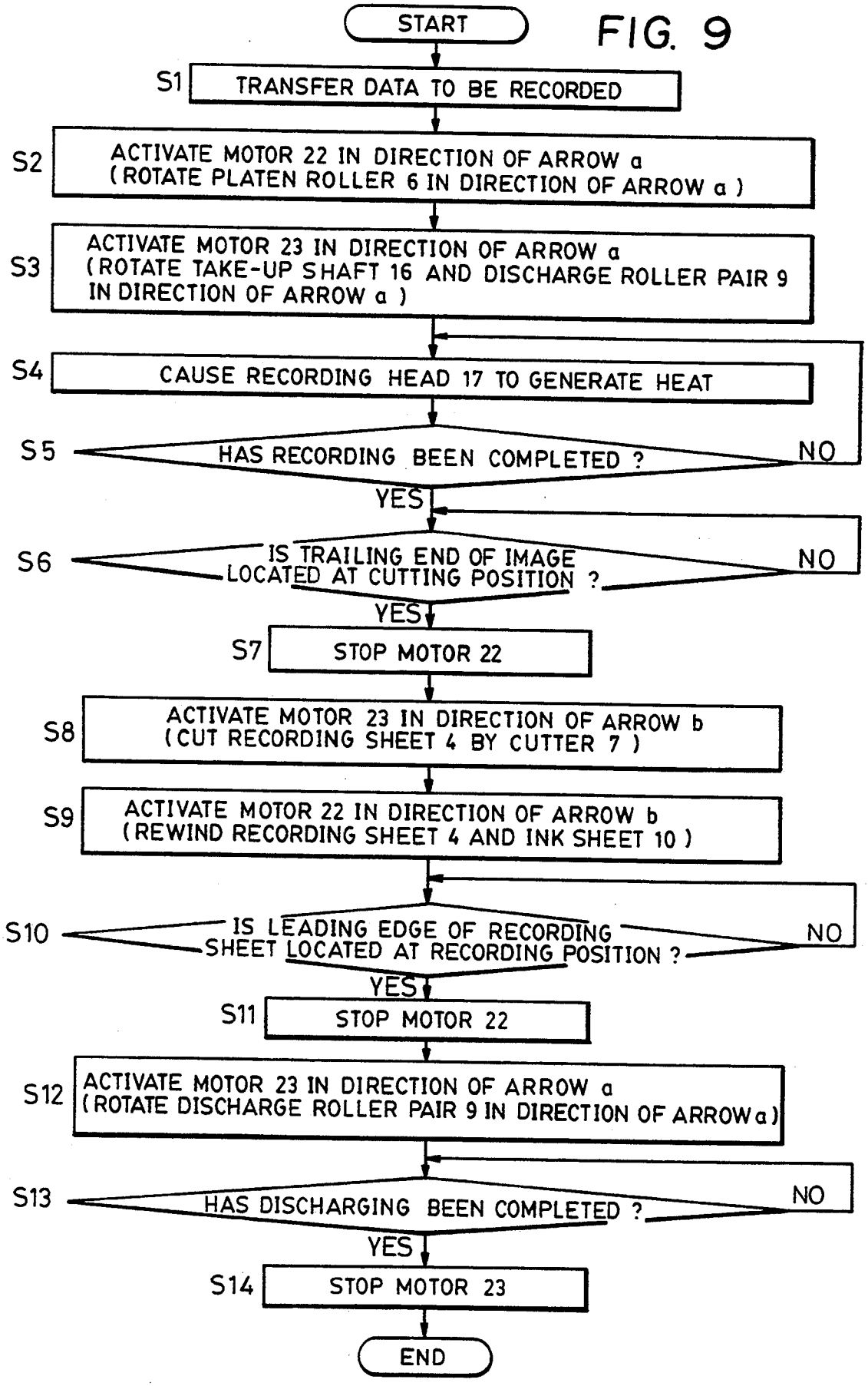
START
FIG. 9
S1
TRANSFER DATA TO BE RECORDED
S2
ACTIVATE MOTOR 22 IN DIRECTION OF ARROW a
(ROTATE PLATEN ROLLER 6 IN DIRECTION OF ARROW a )
S3
ACTIVATE MOTOR 23 IN DIRECTION OF ARROW a
(ROTATE TAKE-UP SHAFT 16 AND DISCHARGE ROLLER PAIR 9
IN DIRECTION OF ARROW a )
S4
CAUSE RECORDING HEAD 17 TO GENERATE HEAT
S5
HAS RECORDING BEEN COMPLETED ?
NO
YES
S6
IS TRAILING END OF IMAGE
LOCATED AT CUTTING POSITION ?
NO
YES
S7
STOP MOTOR 22
S8
ACTIVATE MOTOR 23 IN DIRECTION OF ARROW b
(CUT RECORDING SHEET 4 BY CUTTER 7 )
S9
ACTIVATE MOTOR 22 IN DIRECTION OF ARROW b
(REWIND RECORDING SHEET 4 AND INK SHEET 10 )
S10
IS LEADING EDGE OF RECORDING
SHEET LOCATED AT RECORDING POSITION ?
NO
YES
S11
STOP MOTOR 22
S12
ACTIVATE MOTOR 23 IN DIRECTION OF ARROW a
(ROTATE DISCHARGE ROLLER PAIR 9 IN DIRECTION OF ARROW a)
S13
HAS DISCHARGING BEEN COMPLETED ?
NO
YES
S14
STOP MOTOR 23
END

HEAT TRANSFER RECORDING APPARATUS WITH COMMON DRIVE SOURCE FOR DRIVING PLURAL ELEMENTS

This application is a continuation of application Ser. No. 07/844,939 filed Mar 4, 1992, which is a continuation of Ser. No. 07/333,283 filed Apr. 5, 1989, now abandoned.

BACKGROUND OF THE INVENTION

1. Field of Invention

The present invention relates to heat transfer recording apparatus such as facsimile devices, printers, word processors, copying machines and the like and, more particularly, to a heat transfer recording apparatus which is arranged to transfer ink from a heat transfer printing medium to a recording medium and record an image on the recording medium.

2. Description of the Related Art

In recent years, various types of recording apparatus have been developed and put to practical use as output devices for facsimile devices or the like. One such type of recording apparatus which has been proposed is a heat transfer type of recording apparatus. Such a heat transfer recording apparatus commonly employs an ink sheet made of a base film coated with a thermally transferable ink and is arranged to superpose a recording sheet upon the ink-coated surface of the ink sheet, heat the side of the ink sheet on which the base film is exposed by means of a recording head in accordance with an image signal, and melt, or reduce the viscosity of, the ink, thereby transferring the ink to the recording sheet. The heat transfer recording apparatus having the above-described arrangement is characterized by light weight and low-noise operation, and finds wide application at the present time.

Both of the following arrangements are known for use as a transport mechanism for transporting the ink sheet and the recording sheet in the aforesaid heat transfer recording apparatus. First, there is an arrangement in which a first motor for transporting a recording sheet is disposed separately from a second motor for transporting an ink sheet, the first motor serving to transport the recording sheet alone, while the second motor serves to transport the ink sheet alone. Second, there is an arrangement which uses a single motor to effect transportation of a recording sheet and an ink sheet (for example, Japanese Patent Laid-open No. 150762/1984).

In yet another known arrangement, the driving force of a recording-sheet transporting motor is utilized as the driving force required to drive a discharge roller for discharging a recording sheet after completion of recording.

However, the above-described arrangements involve a number of problems. In the case of the first arrangement, where each element is driven by an individual motor, the number of motors must be increased which in turn increases the manufacturing cost. In addition, in order to practice such an arrangement, a recording apparatus of increased volume is needed, and the size of the apparatus must therefore be increased.

In the case of the second arrangement described above, where a single motor is used to effect transportation of a recording sheet and an ink sheet, since both sheets must be transported at the same time, a large load is applied to the motor. For example, the motor requires a driving load which is approximately twice as large as a driving load applied to the overall heat transfer recording apparatus. As a result, a larger motor is needed and the manufacturing cost for the apparatus increases. Moreover, in order to increase the recording speed of the apparatus, it is necessary to increase the transporting speed of each sheet, and if the output of the motor is to be further increased to achieve this end, an even larger motor must be employed. The consequence is that the manufacturing cost may increase to an even greater extent.

SUMMARY OF THE INVENTION

It is one object of the present invention to provide a heat transfer recording apparatus in which it is possible to reduce the number of motors required to drive individual constituent elements.

It is another object of the present invention to provide a heat transfer recording apparatus of reduced size.

It is another object of the present invention to provide a heat transfer recording apparatus having improved recording speed.

It is another object of the present invention to provide a heat transfer recording apparatus in which, although the number of motors is reduced, each constituent element can be smoothly driven and a clear image can be recorded.

It is another object of the present invention to provide a heat transfer recording apparatus in which driving of cutting means for cutting a recording medium after completion of image recording and transportation of a heat transfer printing medium can be effected by the driving force of a common motor.

It is another object of the present invention to provide a heat transfer recording apparatus which has an enhanced recording speed and whose cost and size can be reduced by decreasing the number of motors.

To achieve the above and other objects, in accordance with the present invention, there is provided a heat transfer recording apparatus which is arranged to transfer ink in the form of an image from a heat transfer printing medium to a recording medium. The apparatus is provided with first transporting means for transporting the heat transfer printing medium, second transporting means for transporting the recording medium, cutting means for cutting the recording medium, and driving-force transmitting means for selectively transmitting the driving force of a common drive source to the first transporting means and to the second transporting means or to the cutting means or both.

Further objects, features and advantages of the present invention will become apparent from the following detailed description of an embodiment of the present invention with reference to the accompanying drawings.

BRIEF DESCRIPTION OF THE DRAWINGS

FIG. 9 is a flow chart showing the operation of the heat transfer recording apparatus to which the embodiment of the present invention is applied.

DESCRIPTION OF THE PREFERRED EMBODIMENT

A full-line type of heat transfer recording apparatus to which a preferred embodiment of the present invention is applied will be described below with reference to the accompanying drawings.

Figure 1:
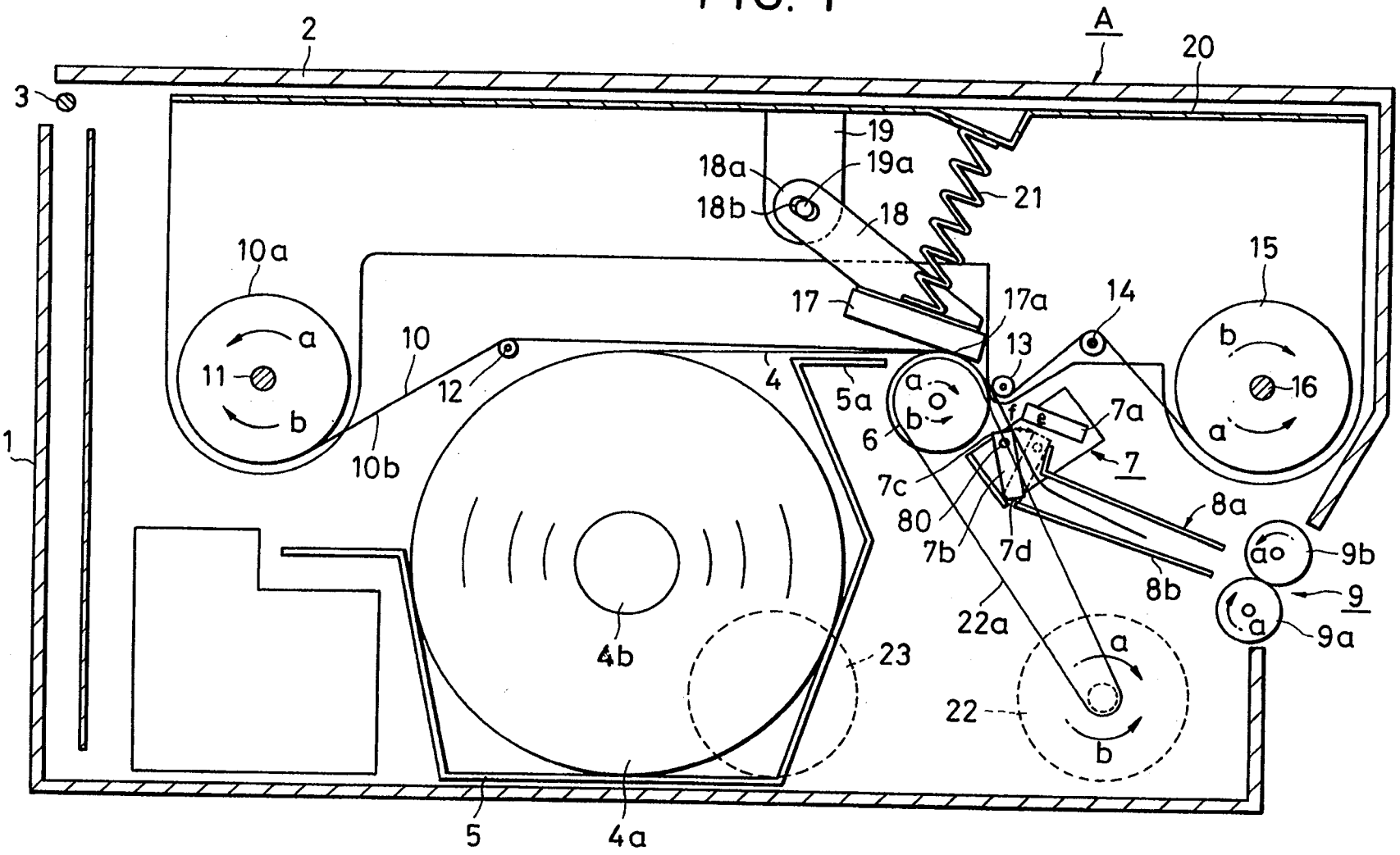
FIG. 1 is a diagrammatic cross-sectional view showing a heat transfer recording apparatus to which an embodiment of the present invention is applied.
Figure 2:
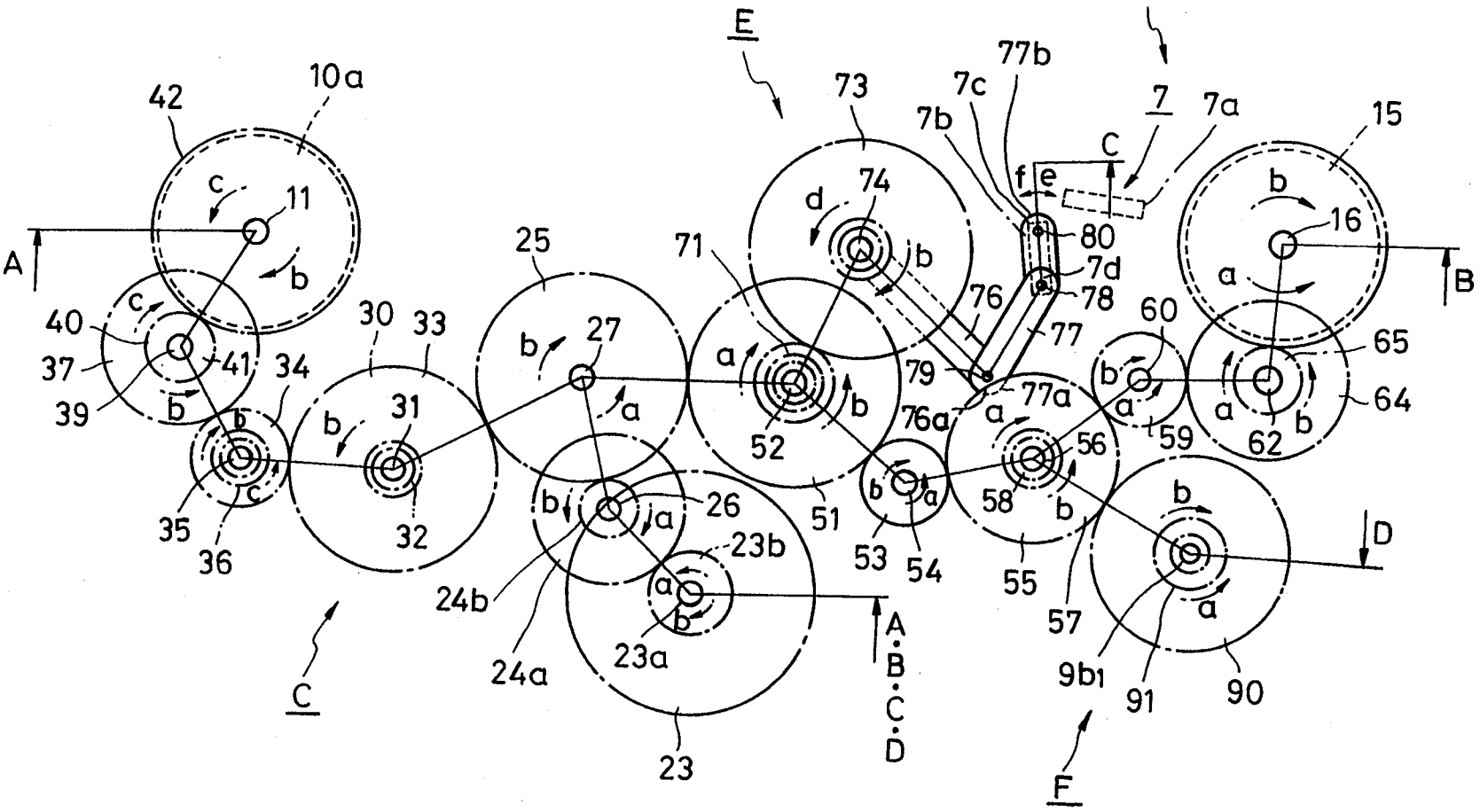
FIG. 2 is a diagram which serves to illustrate a drive system using a motor in the embodiment of the present invention.

FIG. 1 is a cross-sectional view of a heat transfer recording apparatus to which one embodiment of the present invention is applied, and FIG. 2 is a diagram which serves to illustrate a drive system using a motor in an embodiment of the present invention. FIGS. 3, 4, 5 and 6 are sectional views taken along lines A—A, B—B, C—C and D—D of FIG. 2, respectively.

First, the recording section of the heat transfer recording apparatus will be described with reference to FIG. 1, and an input section for recording information will be described later.

In FIG. 1, the body of the heat transfer recording apparatus is indicated generally at A. The body A includes a first casing 1 for accommodating each constituent element, which will be described later, and a second casing 2 which is supported for pivotal motion about a shaft 3 with respect to the first casing 1 and which serves as a lid.

Reference numeral 4 denotes a recording medium such as ordinary paper or a plastic sheet (hereinafter referred to as the "recording sheet") on which an image can be recorded. The recording sheet 4 is wound around a core 4*b* to form a recording sheet roll 4*a*, which is removably accommodated in a holder 5.

When the recording sheet 4 is fed from the recording sheet roll 4*a*, its leading end passes over a guide portion 5*a* which is formed at the end of the holder 5 which is on the sheet-feeding side of roll 4*a*. The thus-fed recording sheet 4 passes through the gap between platen roller 6 and thermal head 17. While the recording sheet 4 is passing through the gap between platen roller 6 and thermal head 17, an image is formed on the recording sheet 4. Then, the recording sheet 4 is passed to the cutter 7; that is, through the space between a fixed cutting member 7*a* and a movable cutting member 7*b* which constitute the cutter 7. The recording sheet 4 then proceeds through the passage between a pair of opposed guides 8*a* and 8*b*, and reaches a discharge roller pair 9 which consists of rollers 9*a* and 9*b*. After the recording sheet 4 has been cut by the cutter 7 along the trailing edge of a portion on which the image has been formed, the cut portion is clamped between the rollers 9*a* and 9*b* and discharged from the body A of the apparatus.

The aforesaid cutter 7 consists of a fixed cutting member 7*a* and a movable cutting member 7*b* which is rotated by a drive system E which will be described later. The cutter 7 is located at an intermediate location on a path along which the recording sheet 4 is discharged. The movable cutting member 7*b* is arranged to rotate about a rotary axis 7*d* in the direction indicated by an arrow e of FIG. 1 to engage with the fixed cutting member 7*a*, thereby cutting the recording sheet 4. After the recording sheet 4 has been cut, the movable cutting member 7*b* is caused to rotate in the direction indicated by an arrow f and return to a stand-by position.

In FIG. 1, reference numeral 10 denotes a heat transfer printing medium (hereinafter referred to as the "ink sheet") which is composed of a base film made from a polyethylene telephthalate resin and a thermally transferable type of ink applied to the base film. The thermally transferable type of ink can be melted or reduced in viscosity by heating. The ink sheet 10 is wound with its inked surface 10*b* exposed to form an ink sheet roll 10*a*. The ink sheet roll 10*a* is disposed at a location above the holder 5, and is removably fitted onto an ink sheet shaft 11 which is driven by a drive system C which will be described later. The ink sheet roll 10*a* is disposed such that, as recording proceeds, the ink sheet 10 is fed from the ink sheet roll 10*a* and, when the recording sheet 4 has been cut by the cutter 7 after completion of the recording, the ink sheet 10 is rewound by a predetermined length.

The leading end of the ink sheet 10, which has been fed from the ink sheet roll 10*a*, is guided by a guide roller 12 and transported over the top of the peripheral surface of the recording sheet roll 4*a*, thus reaching the platen roller 6. In the gap between the platen roller 6 and the thermal head 17, the ink sheet 10 is superposed upon the recording sheet 4 with the inked surface 10*b* maintained in contact with the recording sheet 4. In this state, the thermal head 17 generates heat in accordance with image information to be recorded and ink is thus transferred from the ink sheet 10 to the recording sheet 4 whereby the image is recorded on the recording sheet 4. After completion of the image recording, the ink sheet 10 is separated from the recording sheet 4, transported to a take-up roller 15 by a guide rollers 13 and 14, and wound around the take-up roller 15.

The take-up roller 15 is removably fitted onto a take-up shaft 16 which is driven by a drive system D which will be described later. The take-up roller 15 is arranged to effect winding of the ink sheet 10 in synchronization with the recording process and to rewind the ink sheet 10 around the ink sheet shaft 11 by a predetermined length when the recording sheet 4 has been cut by the cutter 7 after completion of the recording process.

In the presently preferred embodiment, as will be described later, while the ink sheet 10 is being wound, rewound, and transported during the process of image recording, torque limiters 40 and 63 continuously apply a fixed degree of tension to the ink sheet 10. Accordingly, even if an ink sheet 10 made from an extremely thin film is used in the present embodiment, it is possible to prevent wrinkles from being formed in the ink sheet 10. It is, therefore, possible to eliminate any adverse influence that the wrinkles have upon the formation of an image.

The thermal recording head 17 has a contact surface on which a plurality of heat generating elements 17*a* are arranged to individually generate heat in response to an image signal. The heat generating elements 17*a* are disposed in opposed relationship to the peripheral surface of the platen roller 6. The recording head 17 is secured to a lever 18, such as, for example, by an adhesive, and the lever 18 is pivotally supported by a shaft 19*a* of a bracket 19 through a slot 18*b* which is formed in one end 18*a* of the lever 18. A compression spring 21 is held in a compressed state between the back of the recording head 17 and a body frame 20 so that the recording head 17 may be urged against the platen roller 6.

More specifically, the recording sheet 4 and the ink sheet 10 are, as described above, inserted into the gap between the recording head 17 and the platen roller 6. The recording head 17 is pushed by compression spring 21 so that it presses against the ink sheet 10, thereby compressing together the ink sheet 10 and the recording sheet 4. In this compressed state, the heat generating elements 17*a* are caused to generate heat in accordance with the image information to be recorded, thereby melting, or reducing the viscosity of, the thermally transferable ink of the ink sheet 10. Thus, ink is transferred from the ink sheet 10 to the recording sheet 4, whereby the desired image is recorded on the recording sheet 4.

The platen roller 6 is driven by a stepping motor 22 through a gear train or a motion transmission member such as an endless belt or an endless chain. For the purpose of illustration, in this embodiment, an endless chain 22*a* is used as the motion transmission member. When the motor 22 is activated in the direction indicated by a corresponding arrow a or b as shown on motor 22, the platen roller 6 is caused to rotate in the corresponding direction a or b as shown on platen roller 6. In FIGS. 1 and 2, there are depicted a number of rotating elements, and in each case, the direction of rotation indicated by arrow a on that rotatable element is the direction of rotation when recording is being carried out, and the direction of rotation indicated by arrow b on that rotatable element is the direction of rotation when the recording sheet 4 and the ink sheet 10 are being rewound.

In the above-described arrangement, the recording sheet 4 and the ink sheet 10, which are pressed together between the platen roller 6 and the thermal head 17, are simultaneously transported by the rotation of the platen roller 6.

Each of the discharge rollers 9*a* and 9*b* is rotated in the direction indicated by a corresponding arrow a by the drive system D which will be described later.

The ink sheet shaft 11, the take-up shaft 16, the discharge roller 9*a*, and the cutter 7 are arranged to be driven by a stepping motor 23.

The following is a description, referring to FIGS. 2 through 6, of the drive systems C, D and E which are respectively associated with the ink sheet shaft 11, the take-up shaft 16 and the cutter 7, as well as of a drive system F which is associated with the discharge roller 9*a*.

FIG. 2 is a diagram showing the transmission lines of the respective drive systems C to F which are arranged to transmit the driving force of the motor 23. In FIG. 2, the drive system for the ink sheet shaft 11 is represented at C, the drive system for the take-up shaft 16 at D, the drive system for the cutter 7 at E, and the drive system for the discharge roller 9*a* at F.

Figure 3:
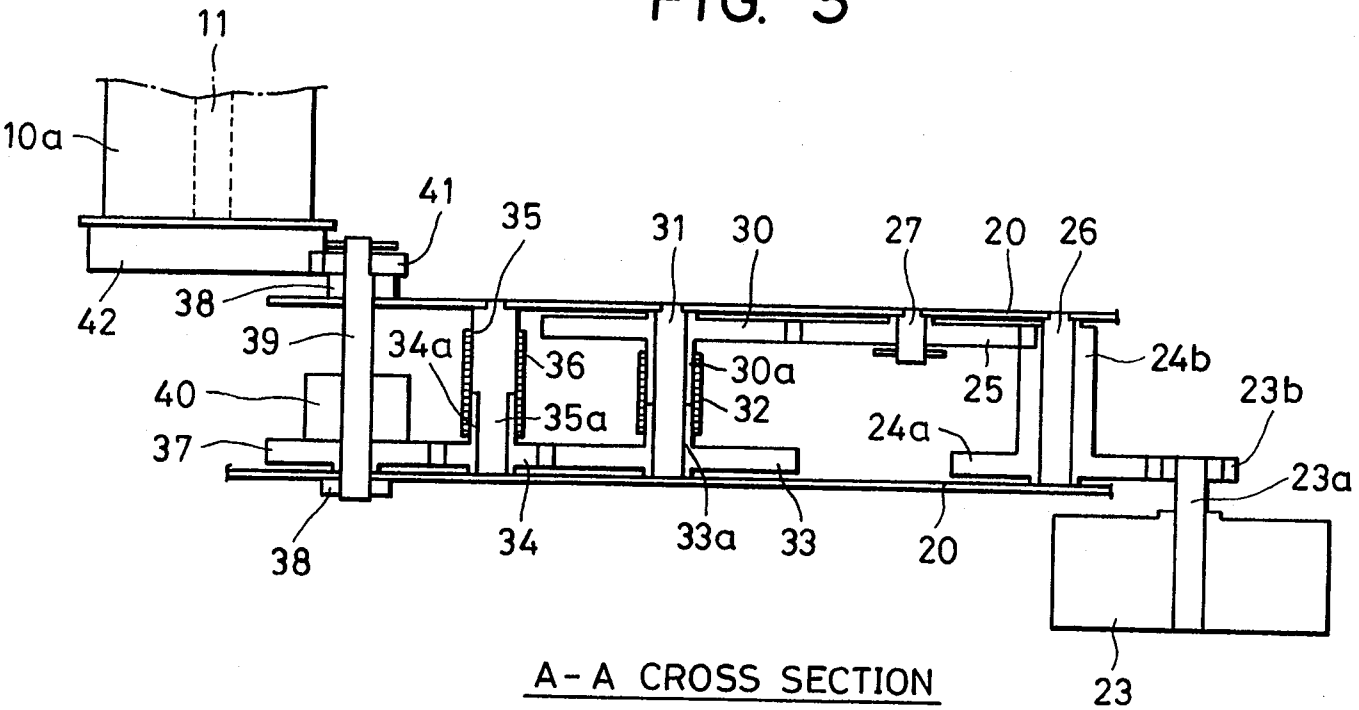
FIG. 3 is sectional view taken along line A—A of FIG. 2.

First of all, the drive system C for the ink sheet shaft 11 will be described with reference to FIGS. 2 and 3.

The motor 23 is fixed at a predetermined location on the body frame 20, and an output gear 23*b* is secured to a shaft 23*a* of the motor 23. The output gear 23*b* is meshed with a gear 24*a* which serves as a first speed reducing gear. A gear 24*b*, which is integrally formed with the gear 24*a*, is meshed with a gear 25 which serves as a second speed reducing gear. The rotary motion of the motor 23 is reduced in speed and transmitted to each section, which will be described later, through the gear train constituted by the output gear 23*b* and the gears 24*a*, 24*b* and 25. The gears 24*a* and 24*b* are supported for rotation about shaft 26, and the gear 25 is supported for rotation about shaft 27. Shafts 26 and 27 are fixed to the body frame 20.

A transmission gear 30 is meshed with the gear 25, and is supported for rotation about a shaft 31 which is fixed to the body frame 20. As shown in FIG. 3, a one-way spring clutch 32 is attached to a boss 30*a* of the transmission gear 30 and, in addition, a gear 33 is supported for rotation about the shaft 31. The gear 33 has a boss 33*a* whose outer diameter is the same as that of the boss 30*a* of the transmission gear 30, and the one-way clutch 32 is disposed to connect the bosses 30*a* and 33*a* so that rotation of the transmission gear 30 is rotatable only in the direction indicated by a corresponding arrow b in FIG. 2.

A clutch gear 34 is meshed with the gear 33, and is supported for rotation about a shaft 35*a* of a stepped shaft 35 which is fixed to the body frame 20. The gear 34 has a boss 34*a* whose outer diameter is the same as that of the large diameter portion of the stepped shaft 35. A one-way clutch 36 is disposed to connect the boss 34*a* and the large diameter portion of the stepped shaft 35. The one-way clutch 36 functions as a brake to prevent the gear 34 from rotating in the direction indicated by an arrow c in FIG. 2.

A gear 37 is meshed with the gear 34. A torque limiter 40 is fixed to a shaft 39 which is rotatably supported by a bearing 38, and the gear 37 is integrally formed with the torque limiter 40. A gear 41 is secured to the shaft 39, and is meshed with a gear 42 which is secured to the ink sheet shaft 11. The torque limiter 40 serves to receive the rotating force transmitted from the motor 23, convert it into constant torque irrespective of the rotational speed of the motor 23, and transmit the constant torque to the shaft 39. The torque thus transmitted is increased or decreased in accordance with the gear ratio of the gear 41 to the gear 42 and transmitted to the ink sheet shaft 11, thereby causing the ink sheet 10 to be rewound.

In the above-described arrangement, the ink sheet shaft 11 is driven in the following manner. While the shaft 23*a* of the motor 23 is rotating in the direction indicated by the corresponding arrow a in FIG. 2, the rotation of the shaft 23*a* is not transmitted from the gear 30 to the gear 33 by the action of the one-way clutch 32 and, therefore, the ink sheet shaft 11 is not driven. When the motor 23 is activated in the direction indicated by the corresponding arrow b, the rotation of the shaft 23*a* is transmitted from the gear 30 to the gear 33 by the action of the one-way clutch 32. Accordingly, the rotation is transmitted to the gear 42 through the clutch gear 34 and the torque limiter 40, thus causing the ink sheet shaft 11 to rotate. During this rotation, tension corresponding to the set value of the torque limiter 40 is applied to the ink sheet 10.

More specifically, as image recording proceeds, the ink sheet 10 is transported by the rotation of the platen roller in the direction indicated by the corresponding arrow a in FIG. 1, while the ink sheet 10 is fed from the ink sheet roll 10*a*. During this time, the rotating force which acts in the direction indicated by the arrow c is applied to the ink sheet shaft 11 through the ink sheet 10 by the platen roller 6. The rotation in the direction of the arrow c is transmitted to the torque limiter 40 through the gears 42 and 41 and further to the clutch gear 34 through the gear 37. The rotation of the clutch gear 34 in the direction indicated by the arrow c is inhibited by the braking action of the one-way clutch 36. Accordingly, torque corresponding to the set value of the torque limiter 40 is applied to the ink sheet shaft 11 and, similarly, tension corresponding to the set value of the torque limiter 40 is applied to the portion of the ink sheet 10 which is passed between the ink sheet shaft 11 and the platen roller 6. This application of tension prevents the ink sheet 10 from being wrinkled.

When image recording has been completed and the trailing edge of the image-formed region of the recording sheet 4 has reached the cutter 7, the movable cutting member **7*b* of the cutter 7 is rotated in the direction of the arrow e to engage with the fixed cutting member 7*a*, thereby cutting the recording sheet 4. Thereafter, when the recording sheet 4 and the ink sheet 10 are being returned in a superposed state to an initial position in which the thermal head 17 is pressed against the platen roller 6 and at which the leading edge of the recording sheet 4 is normally located, the ink sheet shaft 11 is rotated in the direction of the corresponding arrow b. This rotation enables the ink sheet 10** to be rewound while tension is being applied thereto.

The set torque value of the torque limiter 40 is selected to be smaller than the force required for the platen roller 6 to transport the ink sheet 10 during image recording. The rotational speed of the ink sheet shaft 11 is selected so as to be higher than the transporting speed at which the recording sheet 4 and the ink sheet 10 are returned to the initial position after the image recording has been completed and the recording sheet 4 has been cut by the cutter 7.

The drive system C associated with the ink sheet shaft 11 is arranged in the above-described manner. Accordingly, during image recording, the ink sheet 10 is sequentially fed from the ink sheet roll **10*a* by the transporting force of the platen roller 6 and, at the same time, tension corresponding to the set value of the torque limiter 40 is applied to the ink sheet 10. Therefore, formation of wrinkles is prevented. When the recording sheet 4 and the ink sheet 10 are to be returned to the initial position, they are rewound while tension is being applied to the ink sheet 10 through the torque limiter 40 by the rotary motion of the motor 23**.

The drive system D associated with the take-up shaft 16 will be described below with reference to FIGS. 2 and 4.

Figure 4:
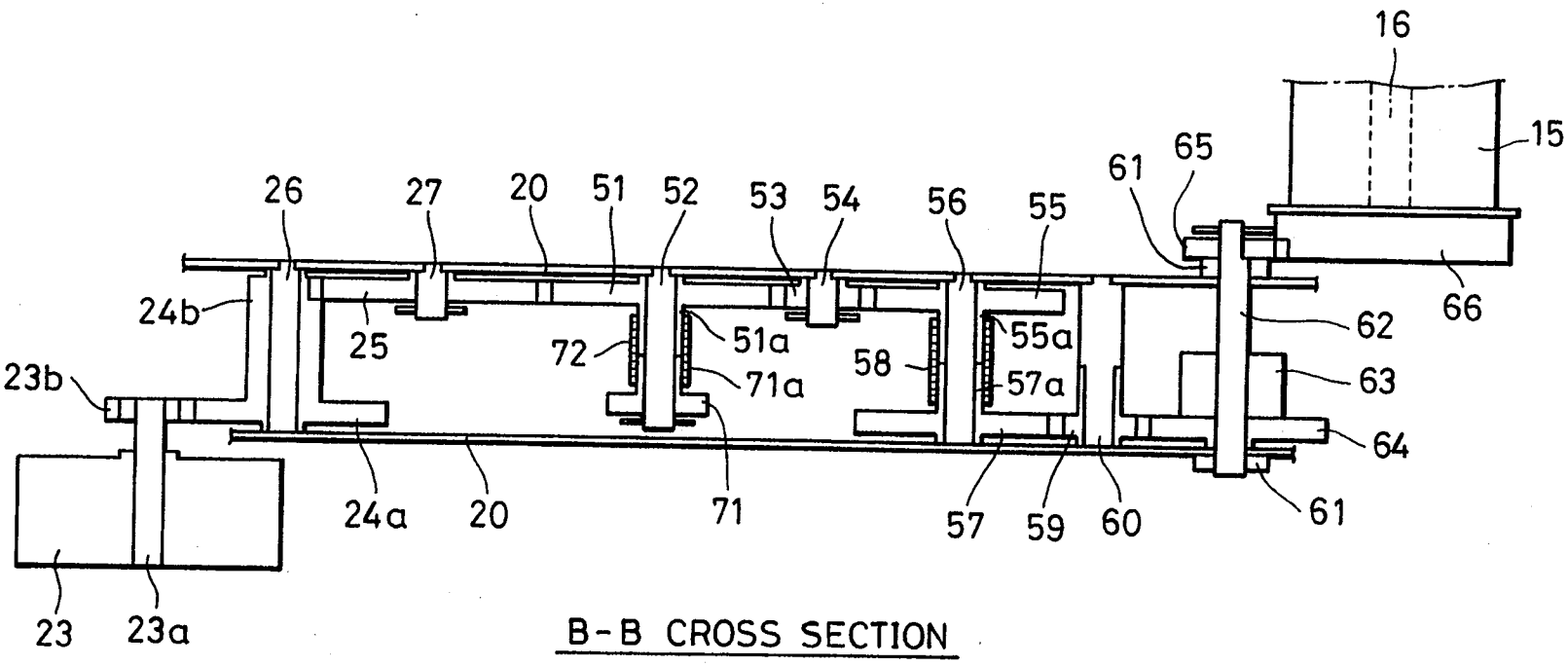
FIG. 4 is sectional view taken along line B—B of FIG. 2.

As shown in FIG. 4, a gear 51 is meshed with the aforesaid gear 25 which serves as the second speed reducing gear. The gear 51 is supported for rotation about a shaft 52 fixed to the body frame 20, and is engaged with a gear 71, through a one-way clutch 72, which allows the drive system D to branch into the drive system E (to be described later) associated with the cutter 7.

An intermediate gear 53 is meshed with the gear 51, and is supported for rotation about a shaft 54 fixed to the body frame 20. A gear 55 is meshed with the gear 53, and is supported for rotation about a shaft 56 fixed to the body frame 20. A gear 57 is also supported for rotation about the shaft 56, and a one-way clutch 58 is disposed to connect a boss **55*a* of the gear 55 and a boss 57*a* of the gear 57. The one-way clutch 58 is arranged so that rotation of the gear 55 in the direction indicated by the corresponding arrow a in FIG. 2 is transmitted to the gear 57**.

A gear 59 is meshed with the gear 57. The gear 59 is supported for rotation about a shaft 60 which is fixed to the body frame 20. Gear 59 is also meshed with gear 64. As shown in FIG. 4, gear 64 is integrally formed with a torque limiter 63 and is fixed to a shaft 62 which is rotatably supported by a bearing 61. A gear 65 is also fixed to the shaft 62, and a gear 66 fixed to the take-up shaft 16 is meshed with the gear 65.

In the above-described arrangement, rotation of the shaft **23*a* of the motor 23 in the direction of the corresponding arrow a is transmitted from the gear 55 to the gear 57 through the one-way clutch 58 and the rotation of the gear 57 is transmitted to the take-up shaft 16 through the torque limiter 63. During this time, constant torque is transmitted from the torque limiter 63 to the shaft 62 irrespective of the rotational speed of the gear 59, and the torque is increased or decreased in accordance with the gear ratio of the gear 65 to the gear 66 and transmitted to the take-up shaft 16. The torque thus transmitted applies tension to the portion of the ink sheet 10 passed between the platen roller 6 and the take-up shaft 16. Accordingly, as recording proceeds, the ink sheet 10 is tensely wound around the take-up shaft 16**.

When the motor 23 is activated in the direction indicated by the corresponding arrow b, the rotation of the gear 55 is not transmitted to the gear 57 by the action of the one-way clutch 58 and, therefore, the take-up shaft 16 is not driven.

The set torque value of the torque limiter 63 is selected to be less than the clamping force which acts upon the ink sheet 10 in the gap between the platen roller 6 and the recording head 17 when recording is not being performed. The rotational speed of the ink sheet shaft 11 is selected to be higher than the transporting speed at which the platen roller 6 transports the recording sheet 4 and the ink sheet 10 during image recording. The difference between the two speeds enables tension to be applied to the portion of the ink sheet 10 that lies between the platen roller 6 and the take-up shaft 16.

The drive system D associated with the take-up shaft 16 is arranged in the above-described manner. Accordingly, when recording is initiated, the motor 23 is driven in the direction of the corresponding arrow a so that the ink sheet 10 can be wound around the take-up shaft 16 while tension corresponding to the set value of the torque limiter 63 is being applied to the ink sheet 10. While the ink sheet 10 and the recording sheet 4 are being returned to the initial position by the rotation of the platen roller 6 after completion of the recording, substantial tension is not applied to the ink sheet 10. However, since the amount of return is small, formation of an image is not adversely affected.

The drive system E associated with the cutter 7 will be described below with reference to FIGS. 2 and 5.

Figure 5:
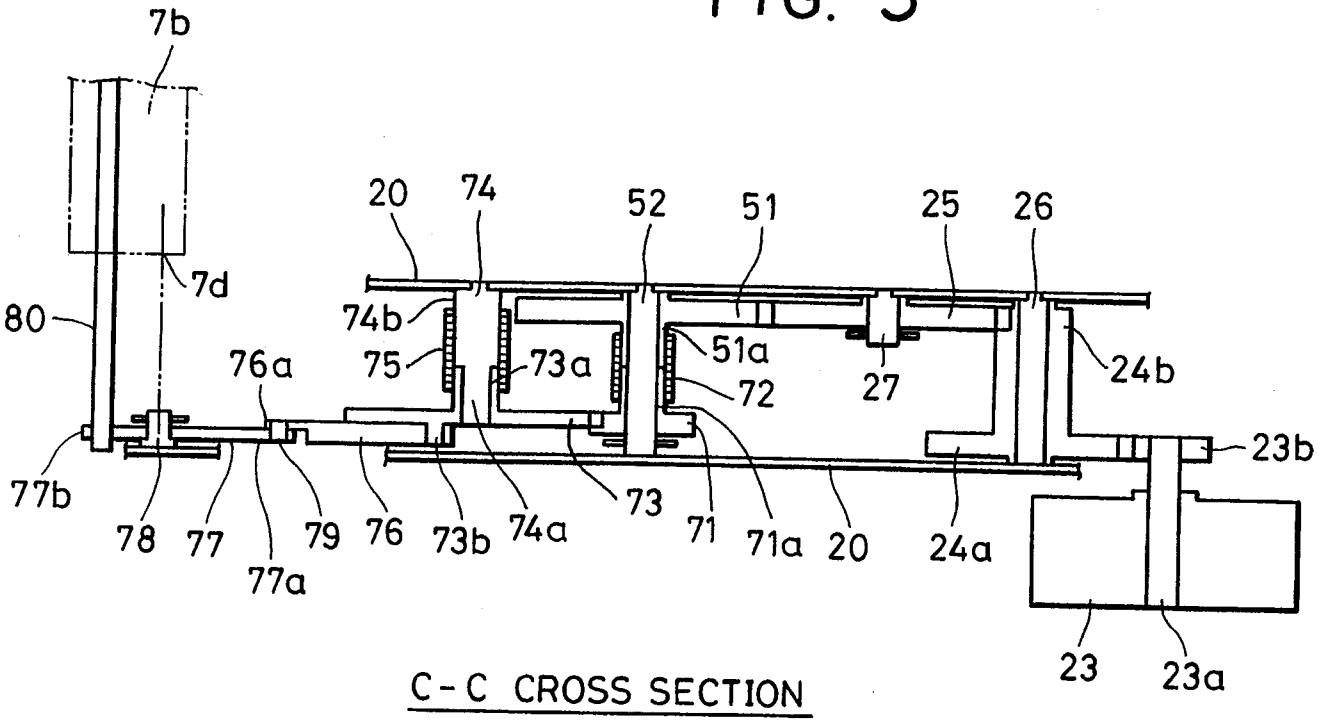
FIG. 5 is a sectional view taken along line C—C of FIG. 2.

As shown in FIG. 5, a gear 71 is supported for rotation about the shaft 52. A one-way clutch 72 is disposed to connect a boss **51*a* of the gear 51 and a boss 71*a* of the gear 71. The one-way clutch 72 is arranged to transmit to the gear 71 the rotation of the gear 51 in the direction indicated by the corresponding arrow b in FIG. 2**.

A gear 73 is meshed with the gear 71, and is supported for rotation about a shaft **74*a* of a stepped shaft 74 which is fixed to the body frame 20. The gear 73 has a boss 73*a* whose diameter is the same as the outer diameter portion of the large diameter portion of the stepped shaft 74, and a one-way clutch 75 is disposed to connect the large diameter of the stepped shaft 74 and the boss 73***a* of the gear 73. The one-way clutch 75 functions as a brake to prevent the gear 73 from rotating in the direction indicated by an arrow d in FIG. 2.

A projection 73*b* is integrally formed on the surface of the gear 73 opposite to the boss 73*a*, and a link 76 is supported for pivotal motion about the projection 73*b*.

As shown in FIG. 2, a link 77 having an approximately V-shaped structure is supported pivotally at its approximate middle portion about a shaft 78 which is fixed to the body frame 20. One end 77*a* of the link 77 is pivotally connected to one end 76*a* of the link 76 by means of a pin 79. The other end 77*b* of the link 77 is supported for pivotal motion about a shaft 80 fixed to a movable end 7*c* of the movable cutting member 7*b* which constitutes a part of the cutter 7.

The shaft 78 is provided on the axis of rotation of the movable cutting member 7*b*, as shown in FIG. 5.

In the above-described arrangement, while the shaft 23*a* of the motor 23 is being rotated in the direction indicated by the corresponding arrow a, the rotation of gear 51, because of the one-way clutch, is not transmitted to gear 71, whereby the cutter 7 is not activated. When the motor 23 is activated in the direction indicated by the corresponding arrow b, the rotation of the gear 51 is, by the action of the one-way clutch 72, transmitted to the gear 71, thus causing the gear 73 to rotate. As the gear 73 rotates, the link 76 is rotated and the rotation of the link 76 is transmitted to the link 77. Thus, the link 77 is rotated about the shaft 78, that is, the axis of rotation of the movable cutting member 7*b* of the cutter 7 in either direction e or f. This rotation is converted into the motion of the movable cutting member 7*b* through the shaft 80 to effect cutting of the recording sheet 4.

The drive system E for the cutter 7 is arranged in the above-described manner. Accordingly, as the shaft 23*a* of the motor 23 rotates in the direction of the corresponding arrow b, the movable cutting member 7*b*, which constitutes a part of the cutter 7, is activated to effect cutting of the recording sheet 4.

Figure 6:
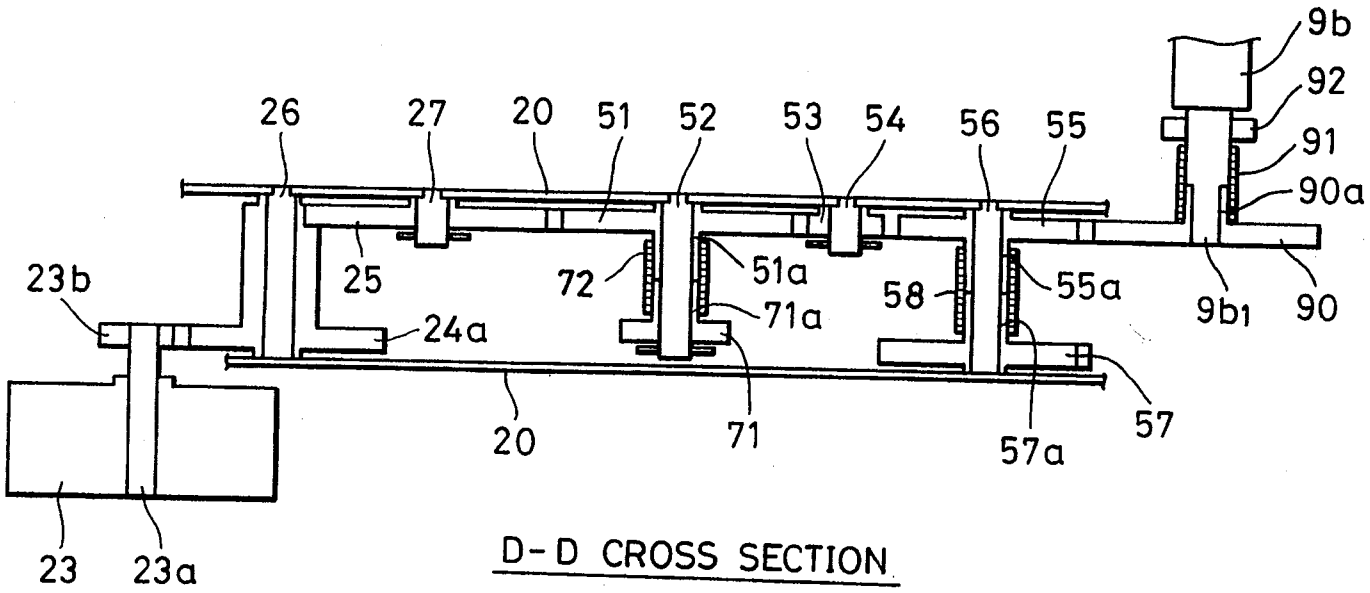
FIG. 6 is a sectional view taken along line D—D of FIG. 2.

The drive system F associated with the discharge roller pair 9 will be described below with reference to FIGS. 2 and 6.

The discharge roller pair 9 is arranged such that driving force is transmitted to the discharge roller 9*b* alone. The discharge roller 9*b* is rotatably supported by a bearing 92 fixed to the body frame 20. One end of the discharge roller 9*b* is provided with a stepped portion $9b_1$, and a gear 90 is supported for rotation about the stepped portion $9b_1$. The gear 90 has a boss 90*a* whose outer diameter is the same as the outer diameter of the large diameter portion of the stepped portion $9b_1$. A one-way clutch 91 is disposed to connect the boss 90*a* and the large diameter portion of the stepped portion $9b_1$. In this arrangement, only when the gear 90 is rotated in the direction indicated by the corresponding arrow a of FIG. 2, rotating force is transmitted to the discharge roller 9*b*.

The gear 90 is meshed with the gear 55 described above. Accordingly, if the motor 23 is activated in the direction indicated by the corresponding arrow a of FIG. 2, the discharge roller 9*b* is also rotated in the direction of the corresponding arrow a, but, if the motor 23 is activated in the direction of the corresponding arrow b in FIG. 2, the discharge roller 9*b* is not rotated.

A control system for controlling the recording apparatus having the above-described arrangement will be described below with reference to the block diagram shown in FIG. 7.

Figure 7:
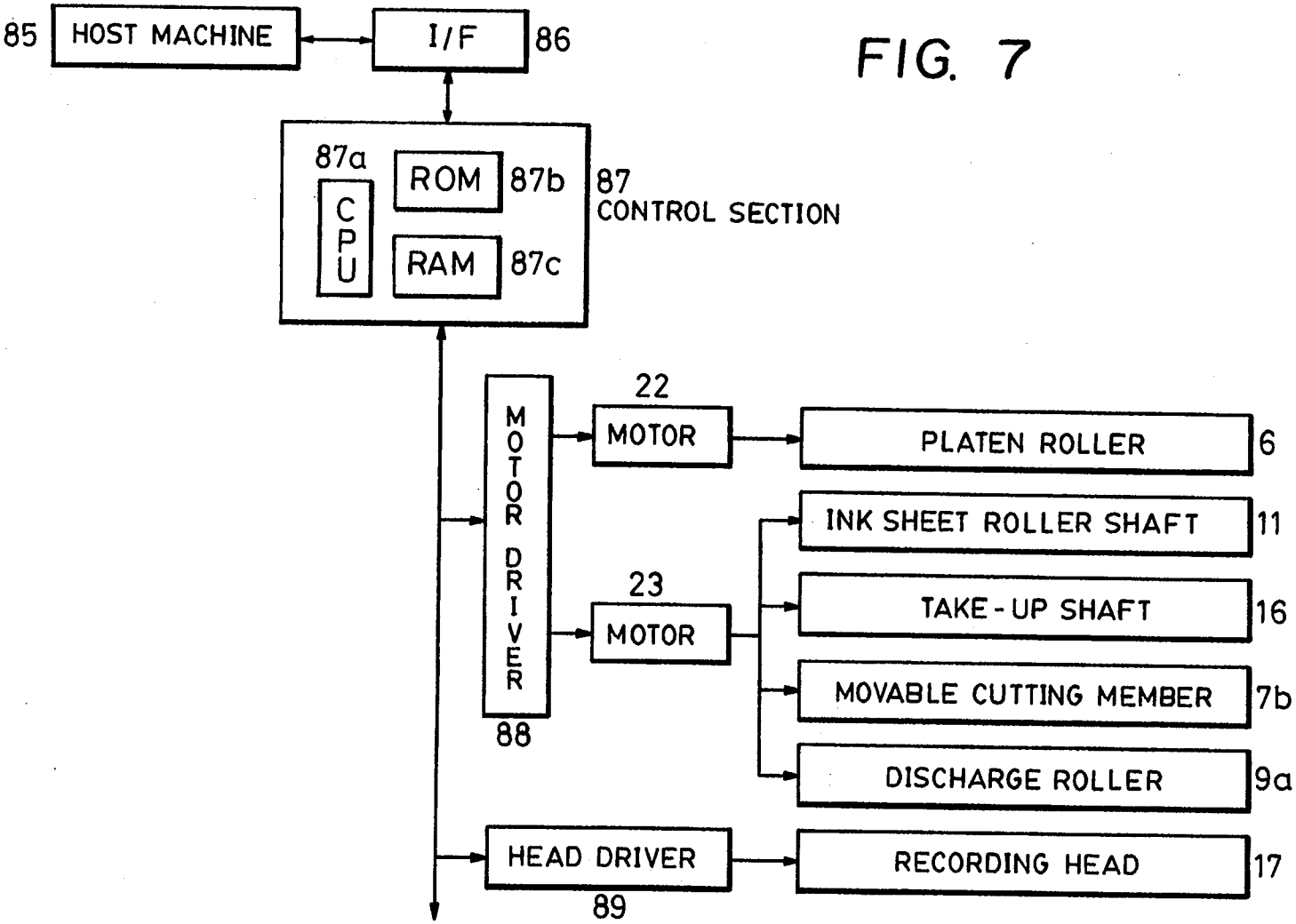
FIG. 7 is a block diagram showing a control system used in the embodiment of the present invention.

In FIG. 7, reference numeral 85 denotes a host machine, such as a word processor, which is used to input information to be recorded, for example, image information or recording start information. The information to be recorded is supplied from the host machine 85 through an interface 86 to a control section 87. The control section 87 includes, for example, CPU 87*a*, such as a microprocessor, ROM 87*b*, in which a control program and various types of data for the CPU 87*a* are stored, and RAM 87*c*, which is used as a work area for CPU 87*a* and for temporarily storing various kinds of data. During the recording operation, control signals for driving the motor 22 and the motor 23 are transmitted from the control section 87 through a motor driver 88 to the respective motors 22 and 23. At the same time, the control section 87 sends a control signal in accordance with image information to the recording head 17 through a head driver 89, thereby selectively heating the heat generating elements on the recording head 17 to record the desired image on the recording sheet 4.

Figure 8:
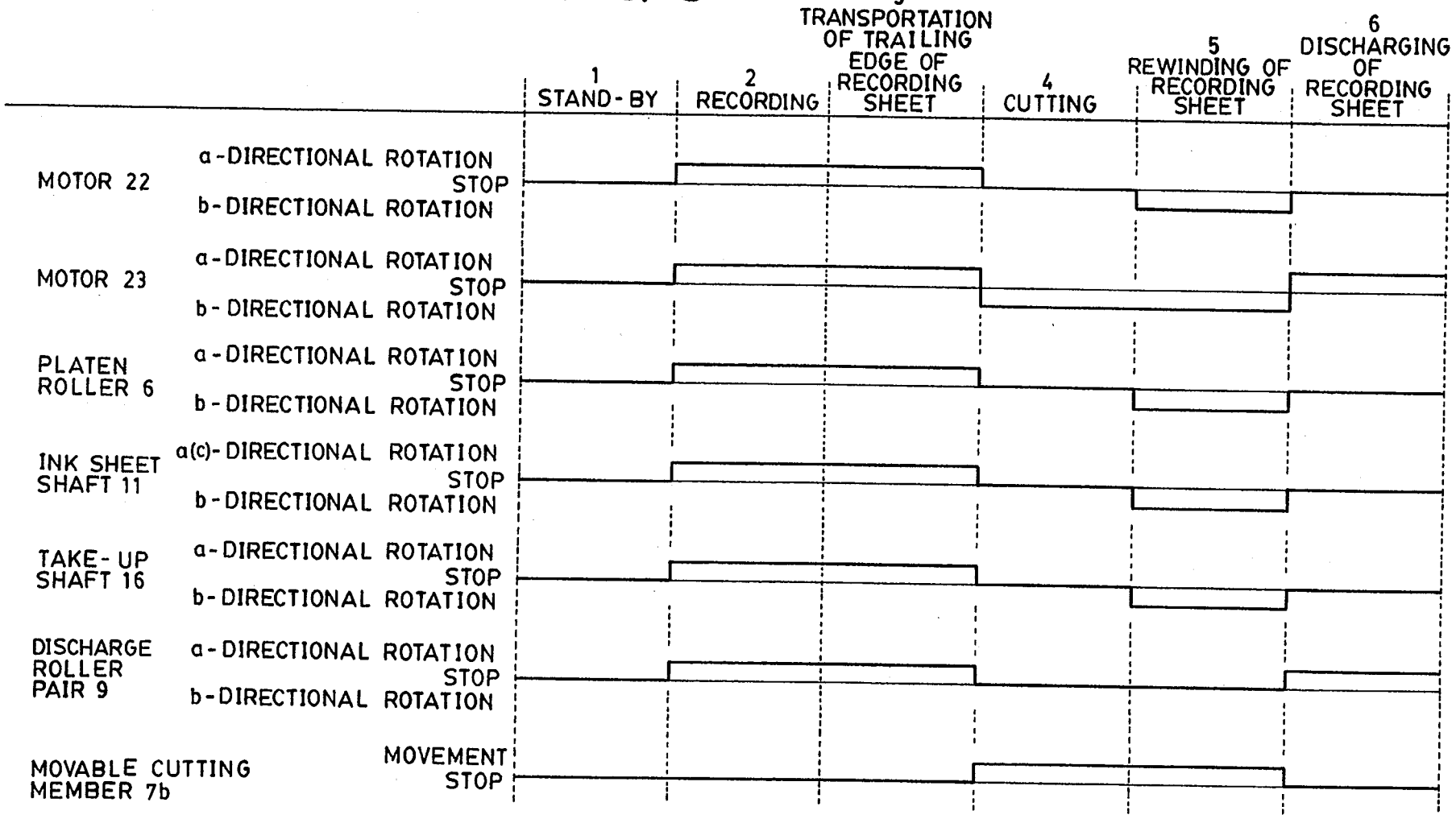
FIG. 8 is a timing chart which serves to illustrate the operation of each operating element in the embodiment.

FIG. 8 is a timing chart which serves to illustrate the sequence of driving operations of the recording apparatus having the above-described arrangement. In the figure, one recording cycle is divided into six steps to illustrate the operations of the respective moving elements in each step.

FIG. 9 is a flow chart which serves to illustrate the sequence of recording operations using the recording apparatus to which the presently preferred embodiment is applied.

The recording operation of the recording apparatus according to the present embodiment will be described below with reference to FIGS. 8 and 9.

In the first step "STAND-BY" of FIG. 8, neither the motor 22 nor the motor 23 is activated.

In Step S1 of FIG. 9, data to be recorded, such as image information and recording start information, is transferred from the host machine 85 to the control section 87, and the process proceeds to Step S2.

In Steps S2 to S5, the motor 22 and the motor 23 are simultaneously activated in the directions indicated by the corresponding arrows a of FIGS. 1 and 2. The platen roller 6 is rotated in the corresponding direction a by the rotating force of the motor 22 to transport the recording sheet 4 and the ink sheet 10. Simultaneously, the rotating force of the motor 23 causes the discharge roller pair 9 and the take-up shaft 16 to rotate in the directions indicated by the corresponding arrows a, thereby winding the ink sheet 10 around the take-up shaft 16 while applying tension to the portion of the ink sheet 10 positioned between the platen roller 6 and the take-up shaft 16. The tension applied during this time is determined by the set value of the torque limiter 40. In addition, the recording head 17 generates heat in response to an image signal to melt, or reduce the viscosity of, the thermally transferable ink applied to the ink sheet 10 in accordance with the desired image pattern. Thus, the desired image is transferred to the recording sheet 4.

The operations of the respective moving elements during the above-described period correspond to the second step "RECORDING" in FIG. 8.

In Step S5, it is determined whether or not recording has been completed. If the recording has not yet been completed, the process returns to Step S4, while if the recording has been completed, the process proceeds to Step S6.

In Step S6, the trailing edge of the image-formed portion of the recording sheet 4 is transported to the cutter 7 by the driving of the motor 22 and the motor 23. This operation corresponds to the third step "TRANSPORTATION OF TRAILING EDGE OF RECORDING SHEET" in FIG. 8.

In Step S7, the driving of the motor 22 is stopped and, in Step S8, the motor 23 is activated in the direction indicated by the corresponding arrow b. Thus, the movable cutting member 7*b* which constitutes a part of the cutter 7 is operated by the drive system E of the cutter 7 to thereby effect cutting of the recording sheet 4. During the cutting operation, the drive system C for the ink sheet shaft 11 is driven by the rotary motion of the motor 23 in the direction of the corresponding arrow b, and tension is thus applied to the portion of the ink sheet 10 passed between the platen roller 6 and the ink sheet shaft 11. However, since the rotation of the platen roller 6 is stopped, the ink sheet 10 is not rewound due to the set torque value of the torque limiter 40. The above-described operation corresponds to the fourth step "CUTTING" of FIG. 8.

In Step S9, the motor 22 is activated in the direction of the corresponding arrow b to move the cut end of the ink sheet 10 and the recording sheet 4 back to the position of the recording head 17 in synchronization with the driving of the motor 23. Since, during this time, tension is applied to the portion of the ink sheet 10 passed between the ink sheet shaft 11 and the platen roller 6, the ink sheet 10 is smoothly rewound without any wrinkle being formed. The above-described operation corresponds to the fifth step "REWINDING OF RECORDING SHEET" in FIG. 8.

It is to be noted that, although the movable cutting member 7*b* of the cutter 7 is moving even while the recording sheet 4 is being rewound; that is, when the motor 23 is running in the direction of the corresponding arrow b of FIG. 2, there is no problem since the rewinding of the recording sheet 4 is not started until after completion of the actual cutting. In addition, the movement of the movable cutting member 7*b* applies tension to the ink sheet 10 during rewinding thereof. Accordingly, it is preferable for the driving of the motors 22 and 23 to be controlled so that the movable cutting member 7*b* can be moving while the cut end of the recording sheet 4 is moving from the cutting portion of the cutter 7 back to the recording position of the recording head 17.

In Step S10, it is determined whether or not the cut end or leading end of the recording sheet 4 has been moved back to the position of the recording head 17. If the answer is "YES", the process proceeds to Step S11, in which case the driving of the motor 22 is stopped. Then, in Step S12, the motor 23 is activated in the direction of the corresponding arrow a of FIG. 2 to cause the discharge rollers 9*a* and 9*b* to rotate in the directions of the respective arrows a. Thus, the portion of the recording sheet 4 to which the desired image has been transferred is discharged from the body A of the apparatus (Step S13) and the recording operation is completed (S14).

In Step S12 described above, the drive system D for the take-up shaft 16 is simultaneously driven to apply tension to the portion of the ink sheet 10 positioned between the platen roller 6 and the take-up shaft 16. However, since the platen roller 6 is not rotating, the ink sheet 10 is not rewound due to the set torque value of the torque limiter 40.

The above-described steps S11 to S13 correspond to the sixth step "DISCHARGING OF RECORDING SHEET" of FIG. 8.

As described above, the motions of the motors 22 and 23 are controlled to effect transportation and rewinding of the recording sheet 4 and the ink sheet 10, as well as cutting and discharging of the recording sheet 4.

Also, the above-described embodiment is arranged to count the number of steps of motors 22 and 23, respectively, and thereby making a decision as to whether or not the trailing edge of an image formed on the recording sheet 4 has been transported from the position of the recording head 17 to the position of the cutter 7, as well as whether or not the cut end of the recording sheet 4 has been moved back to the position of the recording head 17.

In the above-described embodiment, the respective transmission lines of the drive system C for the ink sheet shaft 11, the drive system D for the take-up shaft 16, and the drive system E for the cutter 7 are not limited to the combinations of the gears described above. For example, a transmission line utilizing an endless belt or a chain may be employed.

In the above-described embodiment, a needle type of one-way clutch or a solenoid clutch may be used in place of each one-way clutch utilizing a spring clutch.

Furthermore, in the above-described embodiment, the holder 5 for accommodating the recording sheet roll 4*a*, the platen roller 6, the cutter 7, the guide 8, and the discharge roller 9*a* may be disposed in the first casing 1, while the ink sheet shaft 11, the recording head 17, the take-up shaft 16, and the discharge roller 9*b* may be disposed in the second casing 2.

The above description of the present embodiment is made with reference to the example in which the driving force of the motor 23 is used to effect winding and rewinding of the ink sheet 10, driving of the cutter 7, and rotation of the discharge roller 9*a*. However, the present invention is not limited to such an arrangement. For example, the discharge roller 9*a* may be rotated by the driving force of the motor 22. In that case, the gear 90 shown in FIG. 2 is not needed, and it is still possible to achieve advantages and effects similar to those of the above-described arrangement.

The heat transfer printing medium may be selected from among various recording media having a known type of ink such as thermally fusible ink or thermally sublimable ink.

Although, in this embodiment, a thermal head system using a thermal head is employed as an ink heating system, this arrangement is not construed as a limitative one. For example, an electrically energizing system or a laser transfer system may be employed.

The recording medium useful in this invention is not limited to the above-described recording sheet, and it is possible to utilize any type of material to which ink can be transferred, such as a cloth sheet or a plastic sheet. The arrangement for accommodating an ink sheet is not limited to the one which is used in the particular embodiment described above. For example, a so-called ink sheet cassette of the type in which an ink sheet is accommodated in a container may be used.

As described above, the presently preferred embodiment includes winding means for winding a heat transfer printing medium after completion of image recording, rewinding means for rewinding the heat transfer printing medium before image recording, cutting means for cutting a recording medium after completion of image recording, and discharging means for discharging the recording medium after completion of image recording. These means are arranged to be driven by a common drive source through the respective driving-force transmitting means. Accordingly, winding and rewinding of the heat transfer printing medium or cutting and discharging of the recording medium can be effected by a single drive source. It is, therefore, possible to reduce the cost of the drive source and the space required to incorporate it.

Since the above drive source is disposed separately from transporting means for transporting the recording medium, it is possible to avoid an undue increase in the size of the drive source. In addition, even when the recording speed of the apparatus is to be increased, the outputs of the individual drive sources may be increased. Accordingly, the arrangement according to the present invention provides the advantage of a reduction in the overall cost as compared with an arrangement in which all the operations are controlled by a single drive source or an arrangement in which a plurality of drive sources are disposed to carry out individual operations.

It will be appreciated from the foregoing that, in accordance with the present invention, it is possible to provide a heat transfer recording apparatus with a reduced size.

What is claimed is:

1. A heat transfer recording apparatus in which heat energy which is generated by recording means in accordance with recording signals is applied to a heat transfer printing medium so as to cause an ink of said heat transfer printing medium to be transferred to a recording medium so as to record a predetermined image, comprising:

recording means for recording an image on said recording medium by superposing said heat transfer printing medium having said ink thereon atop said recording medium and applying heat to said heat transfer printing medium, causing said ink to be transferred to said recording medium;

heat transfer printing medium transporting means for transporting said heat transfer printing medium from a supply position to a take-up position;

recording medium transporting means for transporting said recording medium;

recording medium transport driving means for driving said recording medium transporting means;

cutting means for cutting said recording medium;

discharging means for discharging said recording medium cut by said cutting means; and printing medium transport driving means for driving said heat transfer printing medium transporting means, said printing medium transport driving means being a drive source for selectively causing operation of said heat transfer printing medium transporting means and then at least one of said cutting means and said discharging means, said cutting means and said discharging means not being operated simultaneously.

2. A heat transfer recording apparatus according to claim 1, wherein said heat transfer printing medium transporting means further comprises winding means for winding said heat transfer printing medium and rewinding means for rewinding said heat transfer printing medium.

3. A heat transfer recording apparatus according to claim 2, wherein said rewinding means further comprises means for rewinding said heat transfer printing medium and said recording medium in said superposed manner after said recording medium has been cut by said cutting means.

4. A heat transfer recording apparatus according to claim 2, said winding means and said rewinding means being selectively driven by said printing medium transport driving means.

5. A heat transfer recording apparatus according to claim 1, wherein said drive source is a stepping motor, and wherein said printing medium transport driving means further comprises drive-transmitting means for transmitting a driving force from said drive source to at least one of said heat transfer printing medium transporting means, said cutting means, and said discharging means.

6. The heat transfer recording apparatus of claim 1, further comprising torque limiters for continuously applying a fixed degree of tension to the heat transfer printing medium.

7. A heat transfer recording apparatus according to claim 1, wherein said recording means for recording is a thermal head system in which a state of said ink is changed by heat generated by at least one heat resistance element so as to record on said recording medium.

8. A heat transfer recording apparatus according to claim 1, further comprising a torque limiter for adjusting a tension of the heat transfer printing medium transported by the heat transfer printing medium transporting means.

* * * * *

UNITED STATES PATENT AND TRADEMARK OFFICE

CERTIFICATE OF CORRECTION

PATENT NO. : 5,412,407

DATED : May 2, 1995

INVENTOR(S) : AKIO OKUBO, ET AL.

It is certified that error appears in the above-indentified patent and that said Letters Patent is hereby corrected as shown below:

COLUMN 4

Line 9, "telephthalate" should read --teraphthalate--.
Line 37, "by a" should read --by--.

COLUMN 14

Line 26, "said" should read --wherein said--.
Line 27, "being" should read --are--.

Signed and Sealed this

Fifth Day of December, 1995

*Attest:*

*Attesting Officer*

BRUCE LEHMAN

*Commissioner of Patents and Trademarks*